United States Patent [19]

Isaksson

[11] 4,094,265

[45] June 13, 1978

[54] DEVICE IN COLLAPSIBLE ANCHORS

[76] Inventor: Arvid Isaksson, N-Torngatan 17, Lidkoping, Sweden, S-531 00

[21] Appl. No.: 771,517

[22] Filed: Feb. 24, 1977

[30] Foreign Application Priority Data

Mar. 3, 1976 Sweden ..... 7603000

[51] Int. Cl.[2] ..... B63B 21/44

[52] U.S. Cl. ..... 114/307

[58] Field of Search ..... 114/298, 299, 301–308; 52/162, 163; 294/66 R

[56] References Cited

U.S. PATENT DOCUMENTS

| | | | |
|---|---|---|---|
| 337,241 | 3/1886 | Calpin | 114/307 |
| 2,202,856 | 6/1940 | Hottel | 114/305 |

*Primary Examiner*—Trygve M. Blix
*Assistant Examiner*—Jesus D. Sotelo
*Attorney, Agent, or Firm*—Blair & Brown

[57] ABSTRACT

The disclosure relates to a device in collapsible anchors of the type having two shanks each with a sharp-pointed fluke. The ends of the shanks opposite the flukes are provided with inclined portions with through-holes. A bolt, suitably provided with a ring for an anchor line or chain extends through the holes. The bolt, which is intended to rest with an end abutment against one outer side of the mutually adjacent, inclined portions is provided with a resilient washer which fixes the portions in a parallel position. At least one section projecting radially from the bolt hole of one portion is located at a greater distance from the bolt hole than an opposing surface adjacent the second inclined portion. This opposing surface is located such that the projecting section is shiftable out of and into fixed position after shifting of the one inclined portion in a direction away from the second inclined portion against the action of the resilient washer.

7 Claims, 8 Drawing Figures

DEVICE IN COLLAPSIBLE ANCHORS

The present invention relates to a collapsible anchor of the type which has two flukes, the flukes being mounted on two shanks disposed at an angle to each other, and each fluke, which has a sharp point, being fixed to the shank in such a manner that the major portion of the surface of the fluke is located beside and, in the operative position, outside each respective shank and spreads out in a plane which is oblique and located transversely of the longitudinal direction of the shank.

For the purposes of achieving collapsibility, one of the shanks can be provided with a sleeve into which the other shank can be slid and fixedly retained by means of a shackle pin or the like. A disadvantage with this design is that when the anchor is collapsed or assembled, several loose fittings must be taken care of. The object of the present invention is to realize an improved anchor in which loose fittings are dispensed with and in which collapse and assembly can be effected with a minimum of difficulty. One great demand placed on anchors is that it be possible to move the anchor from its stowing position to the letting-go position rapidly and safely and that the anchor, in its letting-go position, be secured in such a manner that there is no risk of the anchor's being accidentally collapsed during the anchoring operation.

According to the present invention, there are provided, at the ends of both shanks opposed to the flukes, inclined portions with through-holes. Moreover, a pin or bolt provided with resilient means and a ring for the anchor rope or chain, extends through the holes. Finally the one inclined portion displays a projection, whereas the other displays an abutment surface cooperating with the projection, the projection and abutment surface forming, in the operative position of the anchor, a positive lock for the shanks whereas they can, when the shanks are acted upon by predetermined force, be shifted from locking position, in that the resilient means gives way, and permit collapsing of the anchor.

One embodiment of the device according to the present invention will be described in greater detail hereinbelow with reference to the accompanying drawings, on which:

Figure 1:
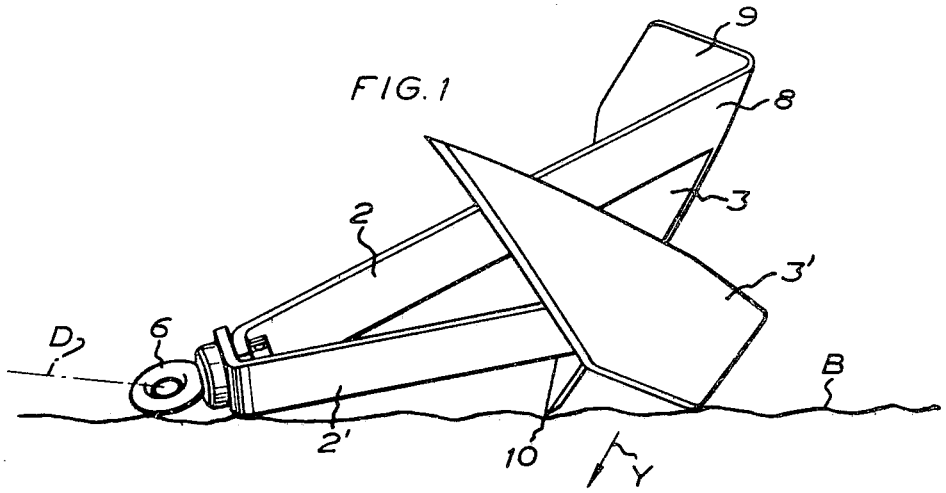
FIG. 1 shows the anchor folded out in the operative position on the sea bed.

The anchor shown on the drawings consists of two parts or halves 1 and 1'. Both parts include an anchor shank 2 and 2', respectively, and a fluke 3, 3', respectively. At the distal or upper end of each shank in relation to the fluke, an inclined portion 4 and 4', respectively, is provided and an eyebolt extends through holes 5 and 5', respectively, in the above-mentioned portions. The function of these fittings will be described in greater detail below.

Since both of the halves 1 and 1' are substantially identical, only one half will be described in detail.

In the half 1, the shank 2 consists of a straight square steel rod or the like which, at its upper end 4, is bent and provided with the hole 5. The fluke 3 is fixed at the other, oblique end 8 of the shank. The fluke consists of a slightly arched plate of relatively thick sheet metal and is —apart from the portion 9 which is located on a level with the joint line between shank and fluke — substantially triangular. It should, however, be noted that the apex of the triangle is offset to that it lies adjacent a plane through the shank. The point or bill 10 of the fluke 3, which thus corresponds to the apex of the triangle, is very sharp as compared with the bills of conventional anchors. The edge portions 11 and 12 of the fluke which are to bury themselves in the sea bed are designed as cutting edges in that the edges at the side of the fluke 3 facing out from the shackle end of the shank are bevelled.

Figure 2:
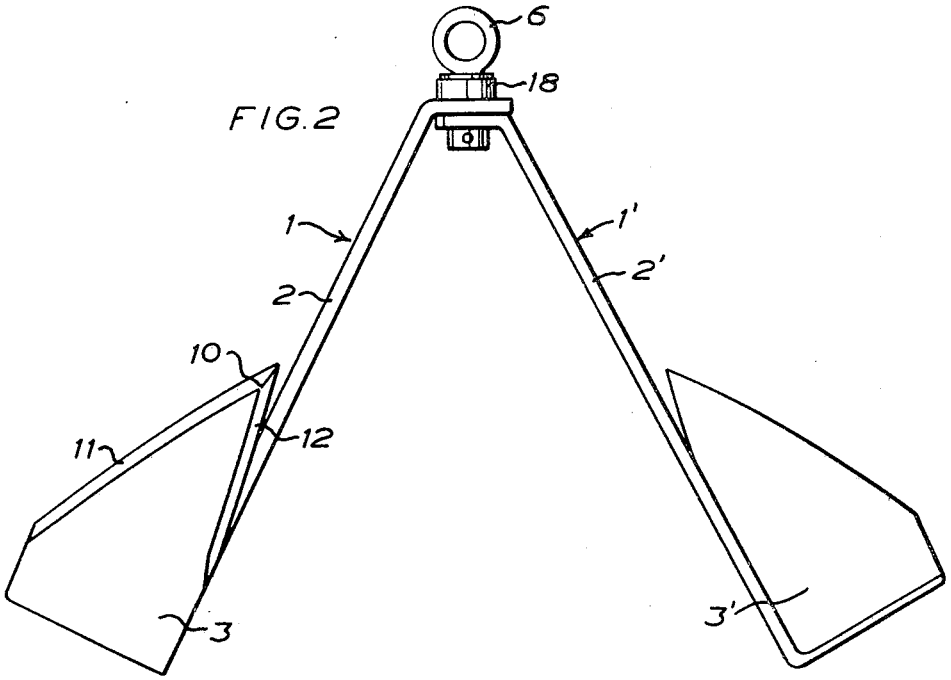
FIG. 2 is a front elevation of the anchor in the folded-out position.
Figure 3:
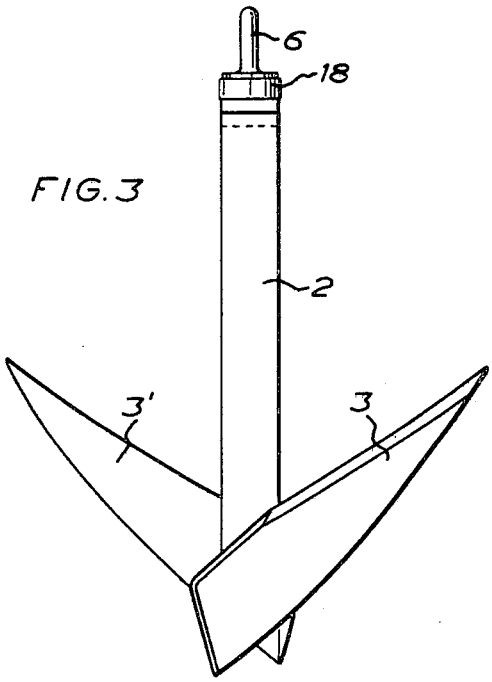
FIG. 3 is a side elevation of the same anchor as in FIG. 2.

The function of the folded-out anchor is apparent from FIGS. 1, 2 and 3. In FIG. 1, the anchor is seen lying on the sea bed B before the anchor line has been tightened. It is apparent from this figure that one fluke 3 rests with its point 10 on the sea bed, whilst the rear edge of the other fluke 3' and the upper ends of the shanks 2, 2' rest against the sea bed. As soon as the anchor line is tightened, the point 10 will bury itself in the sea bed.

In FIG. 1, the sea bed is intimated by means of the line B and the direction of the anchor line is shown by the line D. It is clearly apparent from this drawing that if the line is pulled in the direction D that the fluke will bury itself in the direction Y.

The reason why the position of the apex of the triangle or the point 10 is offset in towards the plane in which the shank 2 lies is apparent from the drawings. Since the anchor, or in any event the operative fluke 3 lies, in the initial position, inclined in relation to the bed B, the point should be laterally offset in order to realize an even loading of the fluke so that it strives to cut through the bed material when the line is tightened and the shank 2 will be aligned with the line.

When engagement with the bed material has been established, that is to say when the fluke 3 has cut down into the bed material, the inoperative half 1' of the anchor (that is to say the shank 2' and the fluke 3') does not participate directly in the retention function, serving merely as a stabilizer.

A substantial advantage in the anchor according to the invention is that, irrespective of how the anchor is turned when it reaches the bottom, one fluke will always turn so that its point can bury itself in the sea bed. If the anchor lies such that the eyebolt faces the wrong direction, the anchor will tip over to turn about the downwardly facing fluke as soon as the anchor line is tightened.

The previously mentioned inclined portions 4 and 4' at the upper ends of the shanks are equidistant from the fluke on each respective shank. Because, as is shown on the drawings, the portions 4 and 4' are to abut against each other, one anchor half will be slightly offset relative to the other half. This entails that the anchor halves can be totally collapsed in on each other so that, as is apparent from FIG. 4, the fluke 3 will lie above the fluke 3' and the shanks will be closely adjacent one another.

The locking mechanism for the anchor parts, in which are included the inclined portions 4 and 4', the eye bolt 6 and the holes 5 and 5' therefor, is constructed and functions in the following manner.

At the inclined portion 4 provided on the one shank 2, the hole 5 is located a predetermined distance *a* from the transistion 13 between the shank and the inclined portion. The hole in the inclined portion 4' provided at the other shank 2' is located a distance *b* from the free end 14 of this portion, the distance *a* being equal to or insignificantly greater than the distance *b*. The distance *c* between the hole 5' and the one slightly bevelled corner 15 of the portion 4' is, on the other hand, greater than the distance *a*. As long as the portion 4' is kept in abutment against the portion 4, the shanks 2 and 2' cannot be turned mutually about the shaft of the eye bolt 6 because of the position of the corners 15 and 16 of the portion 4'. A resilient means in the form of a ring 18 of rubber or the like is mounted between the upper side of the inclined portion 4 of the shank 2 and a washer 17 fixedly disposed on the bolt shaft adjacent the ring. The end of the bolt shaft projecting downwardly through the holes 5 and 5' is provided with a stop ring 19 and the fit between the bolt shaft and at least one of the holes (preferably the hole 5' of the portion 4') should be such that a certain freedom of movement is allowed for. This freedom of movement is achieved if the hole is made conical or possibly biconical.

Biasing of the resilient ring 18 ensures a determined abutment pressure between the inclined portions 4 and 4' of the shanks 2 and 2', and thereby locking of the shanks in the operative position.

Figure 7:
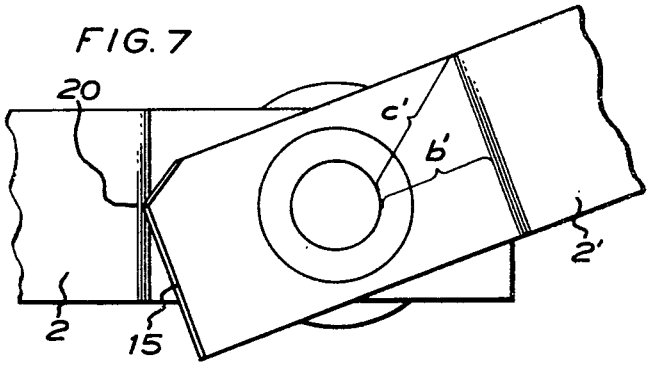
FIGS. 7 and 8 show, in the same manner, the same portion during collapsing or folding out of the shanks.
Figure 8:
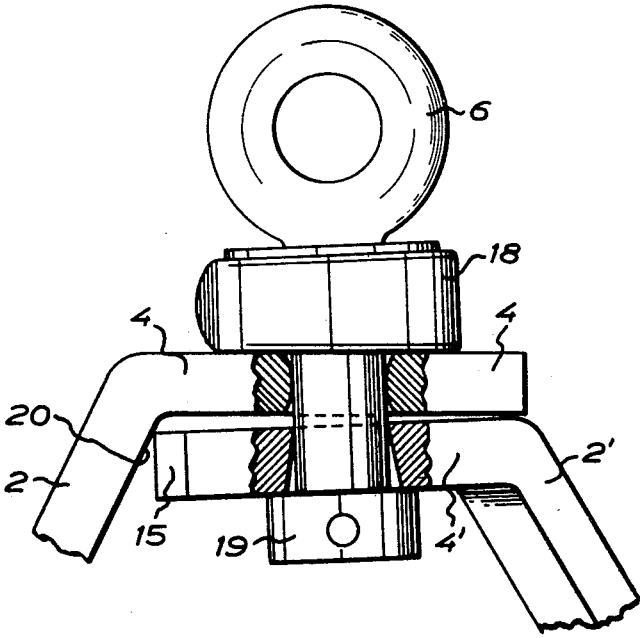

When the anchor is to be collapsed, the flukes are separated from each other, it being possible to cause the corner 15 of the portion 4' to slide past the inner side 20 of the shank 2 which slopes outwardly seen from the hole. When the flukes are separated from each other, the resilient means will, as is apparent from FIGS. 7 and 8, be compressed. The bolt will thereby be shifted slightly in the axial direction and also incline somewhat with respect to the hole 5'. When the projecting corner portion 15 has slid a distance along the shank surface 20 such that the center point of the surface has been passed, the resilient means will assist in the continued movement in the collapsing direction. In the event of movement in the opposite direction, a similar compression of the resilient means must take place before the shanks reach their correct operative position and, also in this case, the means 18 assists in the movement towards the end position once the corner 15 has passed the center point of the shank surface 20.

The idea with the locking of the anchor in the operative position is essentially such that turning of the shanks in relation to each other cannot take place without manual separation of the flukes from each other. Other forces which may act upon the anchor during the anchoring operation will be in the opposite direction, so that the anchor will thereby be locked even harder.

Figure 4:
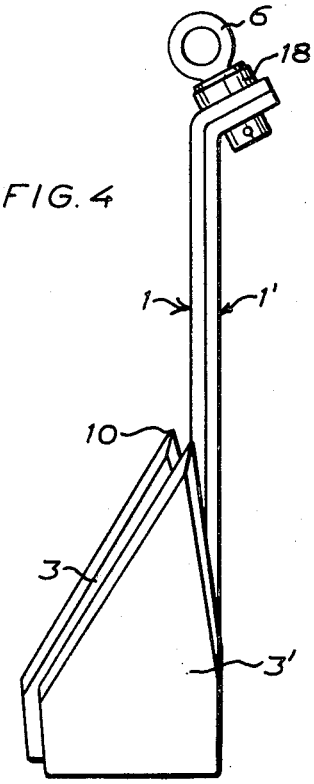
FIG. 4 shows the anchor in the collapsed position.
Figure 5:
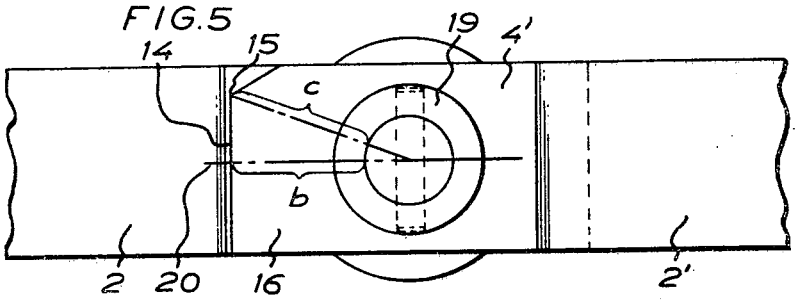
FIGS. 5 and 6 show, on a larger scale and in partial section, the upper portion of the shanks with the locking device in the operative position seen from beneath and from the front, respectively.
Figure 6:
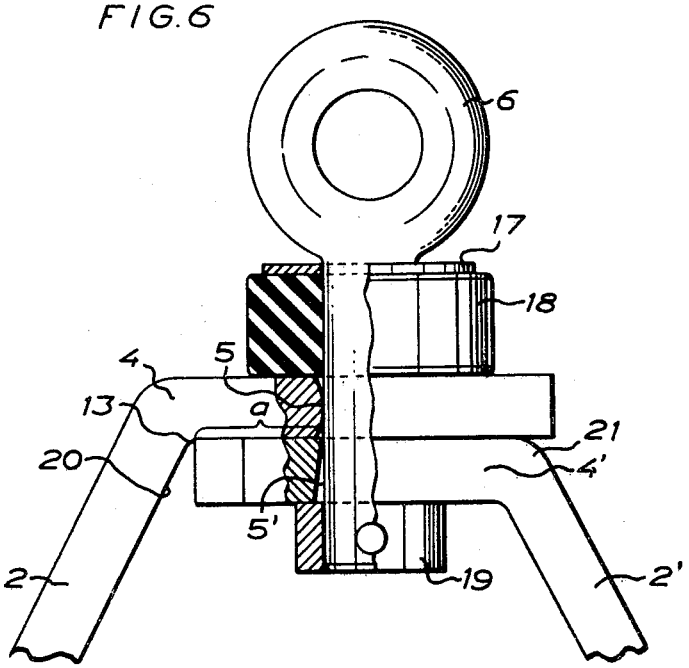

Adaptation of the position of the hole 5' in relation to the region 21 at the transistion between the shank 2' and the portion 4' can realize a similar locking function in conjunction with, and when, the shanks 2 and 2' reach their collapsed position shown in FIG. 4. Thus, the distances *b'* and *c'* in FIG. 7 should correspond substantially to the distances *b* and *c*.

The device according to the present invention realizes a simple, rapid and effective locking mechanism which, moreover, a totally lacks movable parts with a tendency to corrode.

The invention should not be considered as restricted to that described above and shown on the drawings, many modifications being possible within the spirit and scope of the appended claims.

What I claim and desire to secure by Letters Patent is:

1. A device in preferably collapsible anchors of the type having two flukes, said flukes being mounted on two shanks making an angle with each other, and each fluke, which has a sharp point, being fixed to the shank in such a manner that the major portion of the surface of said fluke is located at the side of and, in the operative position outside, each respective shank and spreads out in an inclined plane located transversely of the longitudinal direction of the shank, wherein there are provided, at the ends of the both shanks opposite said flukes, inclined portions with through-holes; wherein a bolt, suitably provided with a ring for an anchor line or chain, extends through the holes; wherein the bolt, which is intended to rest with an end abutment against one outer side of the mutually adjacent, inclined portions, is provided with a resilient means inserted under tension between an opposing abutment provided on the bolt and the other outer side of the mutually adjacent portions and holding said portions together in a parallel position; wherein an end portion extending radially from the bolt hole of one inclined portion is located at a greater distance from said bolt hole than an opposing abutment surface adjacent and connected to the second inclined portion, and wherein said opposing abutment surface is located and designed such that said extending end portion is movable out of and into locked position upon the shifting of said extending end portion of said one inclined portion in a direction away from said second inclined portion against the action of said resilient means.

2. A device as recited in claim 1, wherein said resilient means consists of a ring of rubber or the like.

3. A device as recited in claim 2 wherein said projecting section consists of one, suitably bevelled, corner of the inclined end portion of one of said shanks, and wherein the opposing surface consists of the inner side of the shank located adjacent the transition to the inclined portion of the other shank.

4. A device as recited in claim 2, wherein at least the hole of said one inclined portion is designed with a certain amount of play.

5. A device as recited in claim 1, wherein said projecting section consists of one, suitably bevelled, corner of the inclined end portion of one of said shanks, and wherein the opposing surface consists of the inner side of the shank located adjacent the transition to the inclined portion of the other shank.

6. A device as recited in claim 5, wherein at least the hole of said one inclined portion is designed with a certain amount of play.

7. A device as recited in claim 1, wherein at least the hole of said one inclined portion is designed with a certain amount of play.

* * * * *